United States Patent [19]

Breen et al.

[11] 3,976,047

[45] Aug. 24, 1976

[54] HEAT EXCHANGER

[75] Inventors: Max Breen; James R. Kardas, both of Manchester Center, Vt.

[73] Assignee: American Stovalator Corporation, Manchester, Vt.

[22] Filed: June 5, 1974

[21] Appl. No.: 476,643

[52] U.S. Cl. ..... 126/121
[51] Int. Cl.[2] ..... F24B 7/00
[58] Field of Search ..... 126/121, 136, 123, 120

[56] References Cited

UNITED STATES PATENTS

| | | | |
|---|---|---|---|
| 3,054,394 | 9/1962 | Wright | 126/121 |
| 3,368,545 | 2/1968 | Ibbitson | 126/121 |

FOREIGN PATENTS OR APPLICATIONS

| | | | |
|---|---|---|---|
| 759,793 | 10/1956 | United Kingdom | 126/121 |
| 1,146,191 | 3/1969 | United Kingdom | 126/121 |
| 85 | 11/1895 | United Kingdom | 126/121 |
| 6,997 | 4/1892 | United Kingdom | 126/121 |
| 213,359 | 4/1924 | United Kingdom | 126/121 |

*Primary Examiner*—William F. O'Dea
*Assistant Examiner*—Harold Joyce
*Attorney, Agent, or Firm*—Blum, Moscovitz, Friedman & Kaplan

[57] ABSTRACT

A heat exchanger for optimizing the room heating efficiency of a typical fireplace which comprises a plenum including a radially extending housing having sloped top and bottom walls connected at a closed apex. The housing includes respective air inlet and outlet passages and means for removably mounting the plenum a predetermined distance above a fireplace hearth. The means locates the rearward end of the air inlet passage provided in the plenum angularly above the hearth and the apex of the plenum housing defines a flue passage with the rearward wall of the fireplace for expulsion of effluent gases. The plenum and means are discrete and separable from the fireplace.

5 Claims, 4 Drawing Figures

HEAT EXCHANGER

BACKGROUND OF THE INVENTION

This invention relates generally to a heat exchanger of the type useful for converting radiant heat to a convective hot air. More particularly, the instant invention relates to a means for more effectively utilizing the radiant heat generated in a typical fireplace for room heating.

It is found that the typical fireplace is a very inefficient room heater. Up to about 95 percent of the energy therein is dissipated or expelled through the chimney portion thereof. At the same time, the fireplace produces a draft effect which draws up to about 20% of the house heat through the chimney thereof and creates a cold air draft by air intake through doors and windows. Therefore, it is found that the typical fireplace burns at a net fuel loss rather than gain.

Accordingly, the instant invention provides means for making more efficient use of the heat generated by a conventional fireplace and optimizing the heating effect thereof.

SUMMARY OF THE INVENTION

Generally speaking, in accordance with the invention, a heat exchanger is provided for optimizing the room heating efficiency of a typical fireplace. The heat exchanger comprises a plenum including a radially extending housing having sloped top and bottom walls connected at a closed apex. The housing includes respective air inlet and outlet passages and means for removably mounting the plenum and a predetermined distance above a fireplace hearth. The means locates the rearward end of the air inlet passage provided in the plenum angularly above the hearth and the apex of the plenum housing defines a flue passage with the rearward wall of the fireplace for expulsion of effluent gases. The plenum and means are discrete and separate from the fireplace.

Accordingly, it is an object of this invention to provide a heat exchanger which efficiently utilizes the radiant heat generated in a typical fireplace for heating ambient air.

Another object of the invention is to optimize the ambient heating effect of the typical fireplace.

A further object of the invention is to provide a heat exchanger for optimizing the heating effect of a typical fireplace on ambient air which is discrete and separable from the fireplace.

Still other objects and advantages of the invention will, in part, be obvious and will, in part, be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
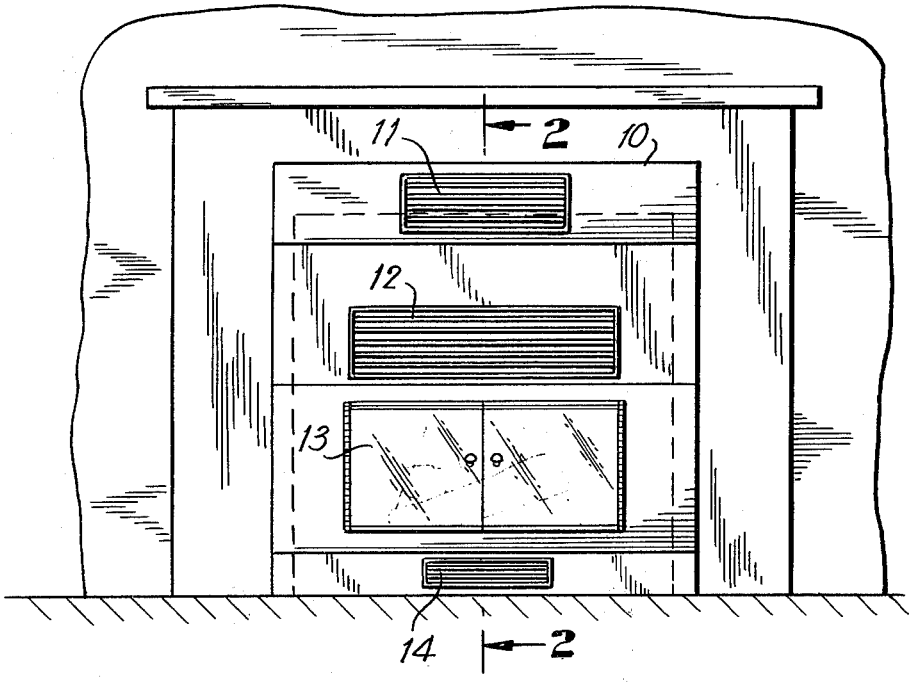
FIG. 1 is a front elevational view of a heat exchanger embodiment constructed in accordance with the invention as installed in a typical fireplace.
Figure 2:
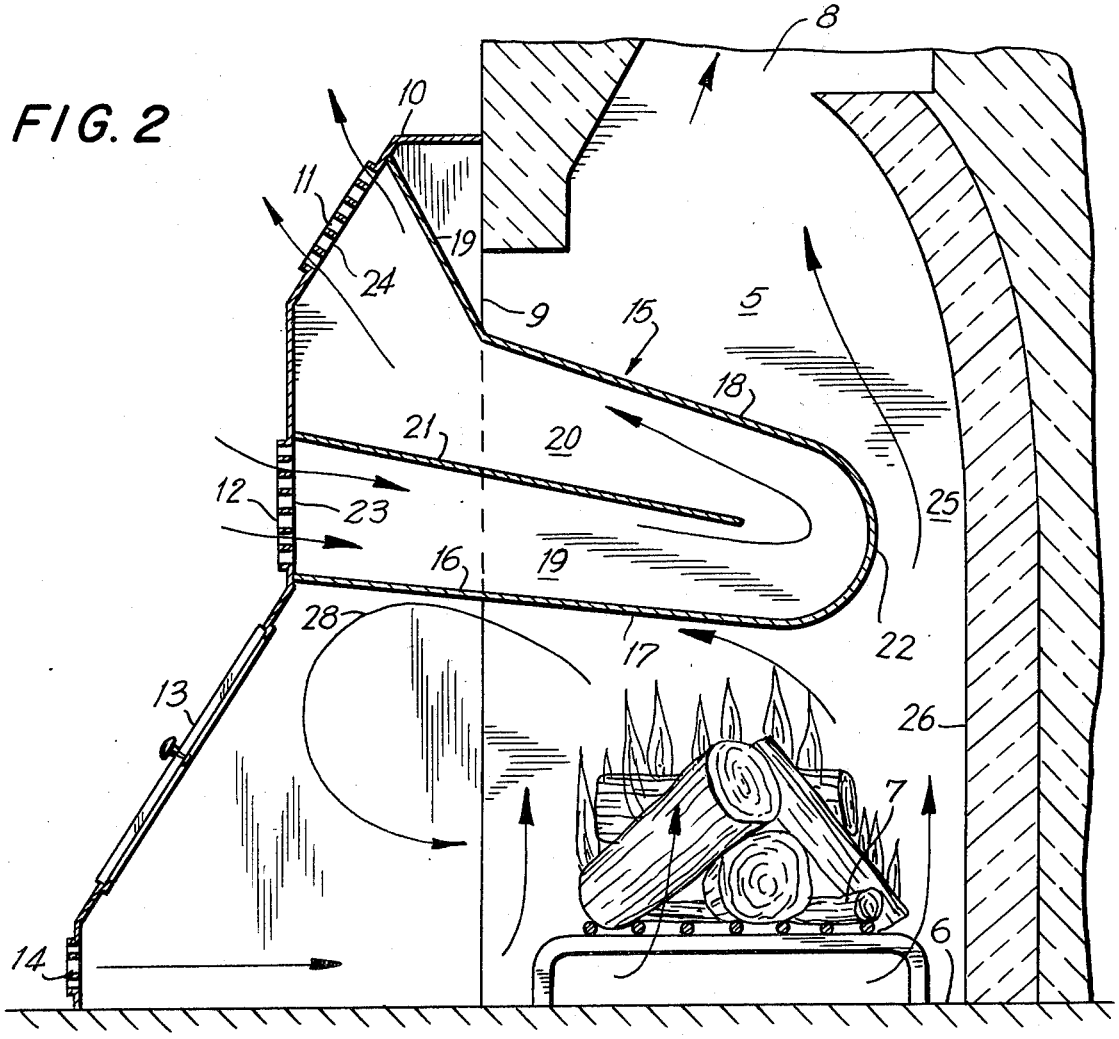
FIG. 2 is a sectional view of the installed embodiment shown in FIG. 1, as taken along line 2—2 thereof.

Referring now to the Figures, like parts are designated by the same numeral. A typical fireplace 5 includes a hearth 6, a fire bed 7 and a flue 8 through which combustion gases are expelled.

Overfitting the hearthway 9 of the fireplace is a casing 10 which includes an air outlet port 11, and air inlet port 12, means 13 for access to fire bed 7 for stoking the fire therein and a damper 14 for drafting the fire provided in the fire bed.

Connected to casing 10 is a plenum generally designated by numeral 15 which includes a radially extending housing 16 having a downwardly sloped bottom wall 17 and a sloped top wall 18 terminating in a tilted front panel 19 connected to casing 10. Within housing 16, an air inlet passage 19 is provided which communicates with an air outlet passage 20. The respective inlet and outlet passages are defined by a tongue 21 connected at at one end to casing 10 and extending interiorly into housing 16, but foreshortened from the apex 22 of housing 16 to provide access between inlet passage 19 and outlet passage 20.

Air inlet port 12 provided in casing 10 overfits the mouth 23 of air inlet passage 19 and air outlet port 11 provided in casing 10 partially overfits the mouth 24 of air outlet passage 20.

Means 13 provided in casing 10 may comprise a pair of doors journalled in the casing which open outwardly for access to the fire bed. Damper 14 may include adjustable slats for regulating the draft introduced into the hearth for bringing the fire bed to an optimum burn. An effluent emission channel 25 is defined between rear wall 26 of the fireplace and the apex 22 of housing 16. Through channel 25, effluent combustion gases are drawn into flue 8 and expelled through the fireplace chimney (not shown).

Figure 4:
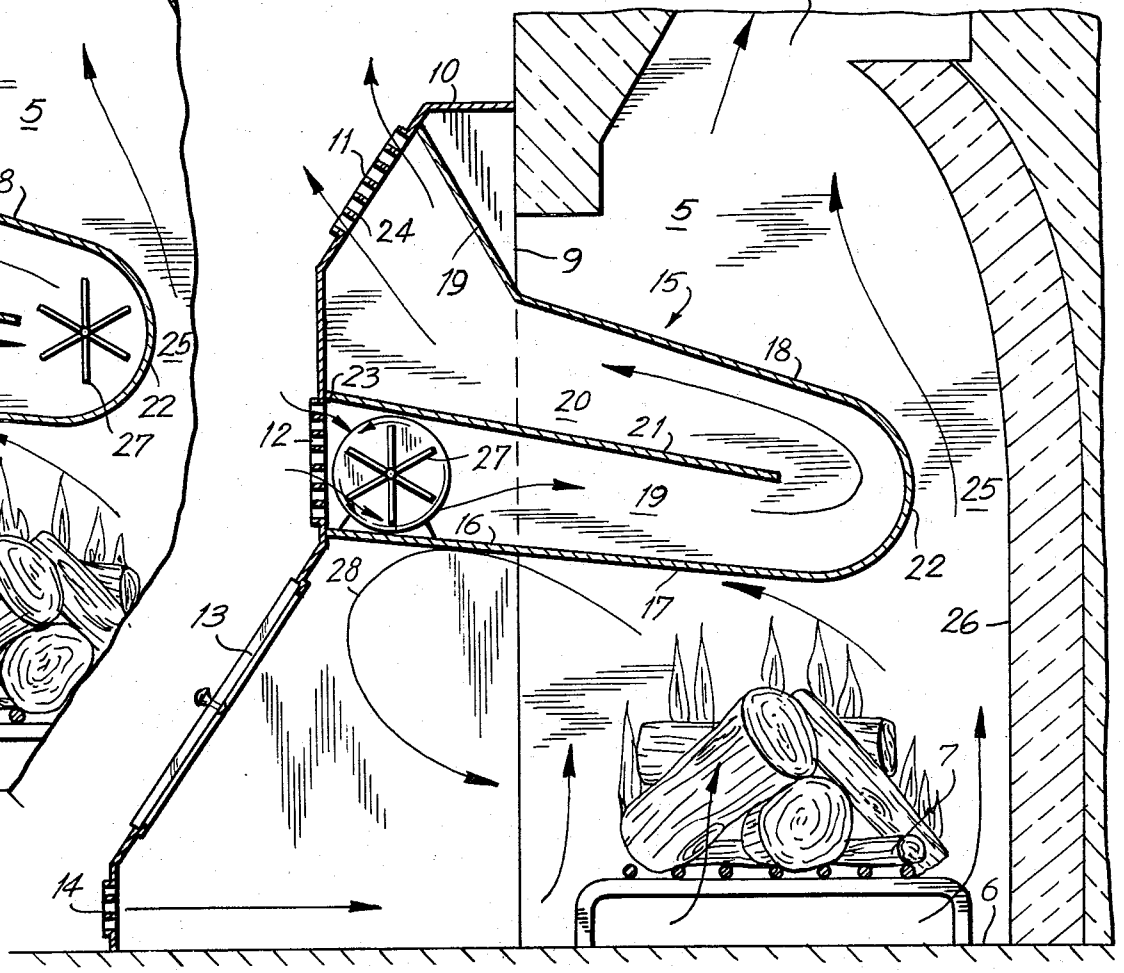
FIG. 4 is the sectional view shown in FIG. 3 including alternate improvement means.
Figure 3:
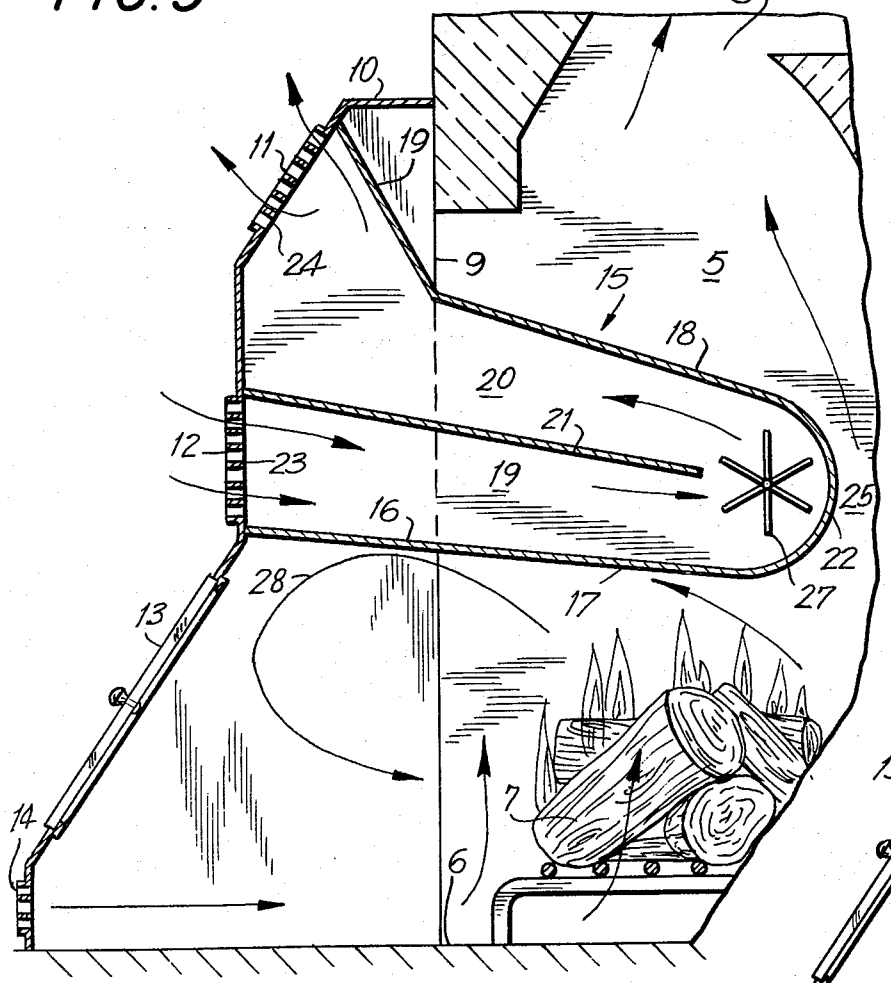
FIG. 3 is the sectional view shown in FIG. 2 including a means for improving the efficiency of the embodiment.

In FIGS. 3 and 4, a fan 27 is mounted in housing 18 for a purpose hereinafter described in detail. In FIG. 3, fan 27 is journalled into the side walls of housing 16 substantially at the apex thereof, where air inlet passage 19 communicates with outlet passage 20. In this embodiment, fan 27 is freely rotatable on one or more journals (not shown) connected thereto. Referring now to FIG. 4, fan 27 is driven, for instance, by a motor (not shown) and is located at the mouth of air inlet passage 19.

In operation, hot combustion gases, radiant heat, and hot ambient air generated and heated by fire bed 7 in part are expelled through channel 25 into flue 8 and in part circulate in heat chamber 27 in the direction shown by directional arrow 28. The circulation in chamber 27 occurs as follows, incoming air through damper 14 is heated by the fire bed and together with effluent combustion gas, rises into contact with bottom wall 17 of housing 16 and transmits heat thereto for warming the air inlet into plenum 15 through inlet passage 19. The cooled admixture of air and effluent gas recirculates to the fire bed since casing 10 prevents the cooled ambient air and effluent gas from being expelled through hearthway 9 into the ambience. A continuous convection current is thereby created for heating the air inlet through passage 19. Air heated in air passage 19 has a natural tendency to rise into outlet passage 20 and is also pushed into outlet passage 20 by incoming inlet air through port 12. The air in outlet passage 20 is introduced into the ambience through outlet port 11. Referring again to FIGS. 3 and 4, the rate of flow of inlet cool air and outlet warm air may be increased by fan 27. Referring particularly to FIG. 3, as warm air deflects against blades of fan 27, fan 27 rotates for thereby increasing the rate of warm air expelled through outlet passage 20 and at the same time provides a draft which increases the rate of air intake into air passage 19.

It is noted that casing 10 and plenum 15 connected thereto are discrete and separable from the fireplace, as desired. Therefore, none of the attractiveness of the fireplace is diminished during warmer weather when heating requirements are minimal or no heat at all is required. Moreover, the removable feature of the device provides for easy upkeep and cleaning of the device as well as maintenance of the fireplace in general.

It will thus be seen that the objects set forth above, among those made apparent from the preceding description, are efficiently attained, and since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A heat exchanger for optimizing the room heating efficiency of a typical fireplace comprising a plenum including a radially extending housing having an upwardly sloped top wall and a downwardly sloped bottom wall connected at a closed apex, said housing including respective air inlet and air outlet passages, and a casing for removably mounting said plenum a predetermined distance above a fireplace hearth, said casing locating the rearward end of said air inlet passage provided in said plenum angularly downwardly towards said hearth, said apex of said plenum housing defining a narrow flue passage with a rearward wall of said fireplace for expulsion of effluent gases, said plenum and said casing being discrete and separable from said fireplace, said casing overfitting said fireplace hearthway and said plenum being fixedly connected thereto, said casing including an air inlet port overfitting said air inlet passage of said plenum housing, an air outlet port overfitting said outlet passage of said plenum housing, a draft port for drafting a fire provided on the hearth of said fireplace, means for access to said fireplace hearth, and an interiorly extending tongue foreshortened from said apex thereof, said tongue thereby defining with said top and bottom walls of said housing said air inlet and air outlet passages.

2. The heat exchanger as claimed in claim 1, including a means mounted in said apex of said plenum housing which is actuable by air inlet through said air inlet passage for increasing the air outlet rate through said air outlet passage and providing concurrently therewith an air inlet draft.

3. The heat exchanger as claimed in claim 2, said means including a freely rotatable fan journalled in respective side walls of said plenum housing.

4. The heat exchanger as claimed in claim 1, including a driven means mounted in the mouth of said air inlet passage of said plenum housing for driving air through said air inlet passage into said air outlet passage, and a means for driving said driven means.

5. The heat exchanger as claimed in claim 4, said driven means being a rotatable fan.

* * * * *